US007448684B2

(12) United States Patent
Hsiao

(10) Patent No.: US 7,448,684 B2
(45) Date of Patent: Nov. 11, 2008

(54) BACKREST ADJUSTMENT DEVICE

(75) Inventor: Hsueh-Sheng Hsiao, Jiayi Hsien (TW)

(73) Assignee: Chen Hsing Enterprise Co., Ltd., Zhuchi Hsiang (TW)

( * ) Notice: Subject to any disclaimer, the term of this patent is extended or adjusted under 35 U.S.C. 154(b) by 381 days.

(21) Appl. No.: 11/168,687

(22) Filed: Jun. 28, 2005

(65) Prior Publication Data

US 2006/0290189 A1 Dec. 28, 2006

(51) Int. Cl.
*A47C 7/46* (2006.01)

(52) U.S. Cl. ..... 297/284.8

(58) Field of Classification Search ..... 297/284.4, 297/284.8

See application file for complete search history.

(56) References Cited

U.S. PATENT DOCUMENTS 1,743,377 A * 1/1930 Nadell ..... 297/383
4,678,230 A * 7/1987 Winkle ..... 297/284.4
5,088,790 A * 2/1992 Wainwright et al. ..... 297/284.4
6,092,871 A * 7/2000 Beaulieu ..... 297/284.4
6,695,402 B2 * 2/2004 Sloan, Jr. ..... 297/284.4
2002/0130541 A1 * 9/2002 Koo ..... 297/284.7

FOREIGN PATENT DOCUMENTS

EP 582821 A1 * 2/1994

* cited by examiner

*Primary Examiner*—Joseph F Edell
(74) *Attorney, Agent, or Firm*—Alan Kamrath; Kamrath & Associates PA

(57) ABSTRACT

A backrest adjustment device includes a bottom board, a support board movable relative to the bottom board, and two opposite linkages pivotally mounted between the support board and the bottom board to drive the support board to move relative to the bottom board to change the distance between the support board and the bottom board. Thus, the two linkages are pivoted to drive the support board to move relative to the bottom board to change the distance between the support board and the bottom board so as to adjust the position of the backrest relative to the seat.

5 Claims, 8 Drawing Sheets

BACKREST ADJUSTMENT DEVICE

BACKGROUND OF THE INVENTION

1. Field of the Invention

The present invention relates to a backrest adjustment device, and more particularly to a backrest adjustment device for a chair, a wheelchair or the like.

2. Description of the Related Art

A conventional chair comprises a seat, a backrest, and two armrests. However, the backrest is fixed on the seat, so that the position between the backrest and the seat is fixed and cannot be adjusted any more so as to fit users of different statures, thereby causing inconvenience to the users.

SUMMARY OF THE INVENTION

In accordance with the present invention, there is provided a backrest adjustment device, comprising a bottom board, a support board movable relative to the bottom board, and two opposite linkages pivotally mounted between the support board and the bottom board to drive the support board to move relative to the bottom board to change a distance between the support board and the bottom board.

The primary objective of the present invention is to provide a backrest adjustment device having a position adjustment function.

Another objective of the present invention is to provide a backrest adjustment device, wherein the two linkages are pivoted to drive the support board to move relative to the bottom board to change the distance between the support board and the bottom board so as to adjust the position of the backrest relative to the seat.

A further objective of the present invention is to provide a backrest adjustment device, wherein the gear portions of the two linkages mesh with each other so that the two linkages are pivoted simultaneously to change the distance between the support board I and the bottom board so as to adjust the position of the backrest relative to the seat smoothly and exactly.

A further objective of the present invention is to provide a backrest adjustment device, wherein the two linkages co-operate with the two secondary linkages to drive the support board to move relative to the bottom board so as to doubly increase the travel between the support board and the bottom board.

Further benefits and advantages of the present invention will become apparent after a careful reading of the detailed description with appropriate reference to the accompanying drawings.

DETAILED DESCRIPTION OF THE INVENTION

Figure 1:
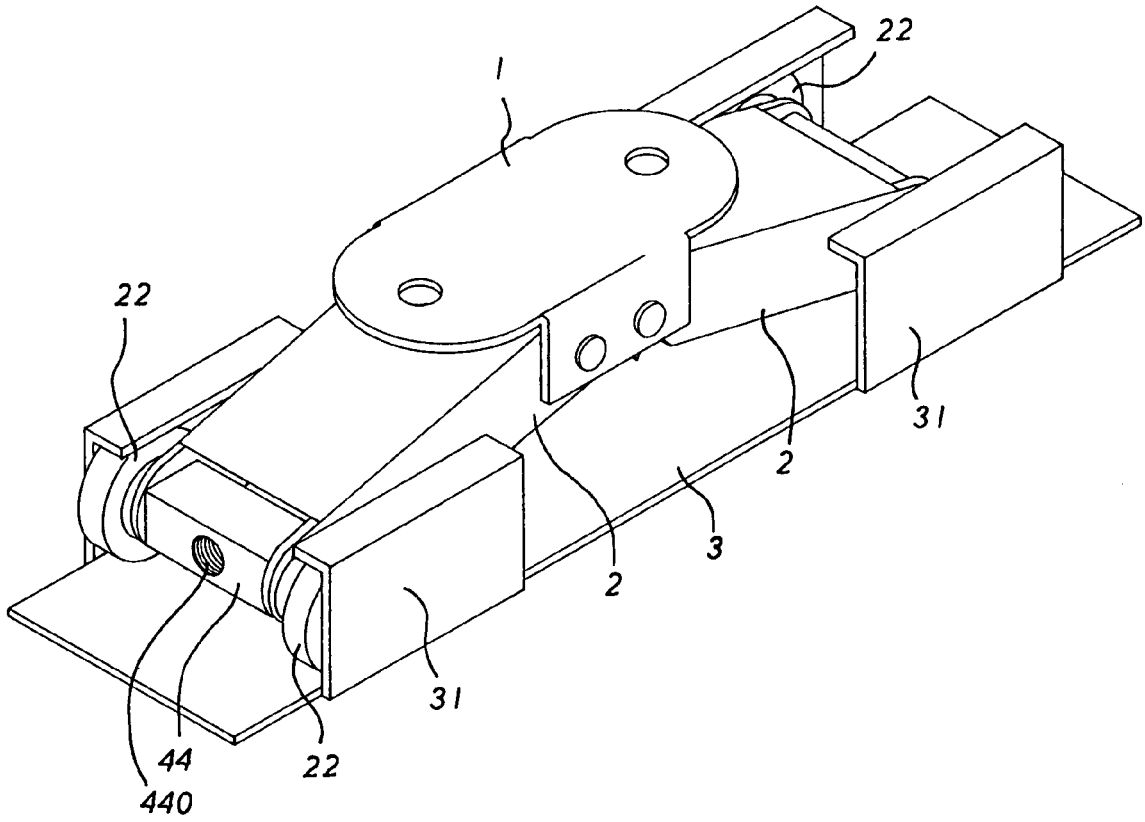
FIG. 1 is a perspective view of a backrest adjustment device in accordance with the preferred embodiment of the present invention.
Figure 2:
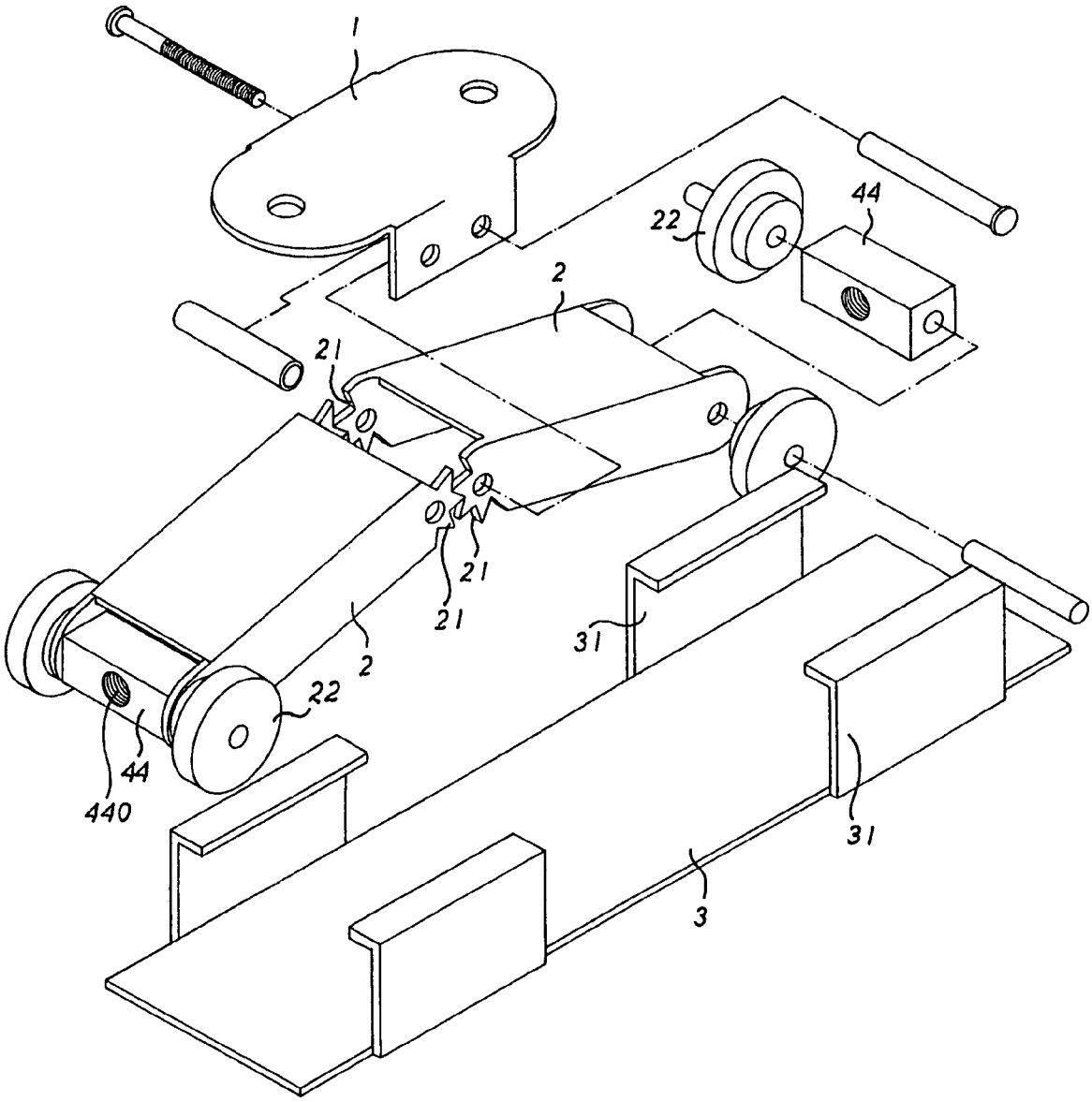
FIG. 2 is an exploded perspective view of the backrest adjustment device as shown in FIG. 1.

Referring to the drawings and initially to FIGS. 1 and 2, a backrest adjustment device in accordance with the preferred embodiment of the present invention comprises a bottom board 3, a support board 1 movable relative to the bottom board 3, and two opposite linkages 2 pivotally mounted between the support board 1 and the bottom board 3 to drive the support board 1 to move relative to the bottom board 3 to change a distance between the support board 1 and the bottom board 3.

Each of the two linkages 2 has a first end movably mounted on the bottom board 3 and a second end pivotally mounted on the support board 1 to drive the support board 1 to move relative to the bottom board 3. The second ends of the two linkages 2 are engaged with each other so that the second ends of the two linkages 2 are pivoted simultaneously. The second end of each of the two linkages 2 is formed with a gear portion 21, and the gear portions 21 of the two linkages 2 mesh with each other so that the second ends of the two linkages 2 are pivoted simultaneously and the two linkages 2 are pivoted simultaneously.

The bottom board 3 has two ends each provided with a guide track 31 to guide movement of the first end of each of the two linkages 2. The first end of each of the two linkages 2 is provided with two rollers 22 rotatably mounted in the respective guide track 31 of the bottom board 3.

Figure 3:
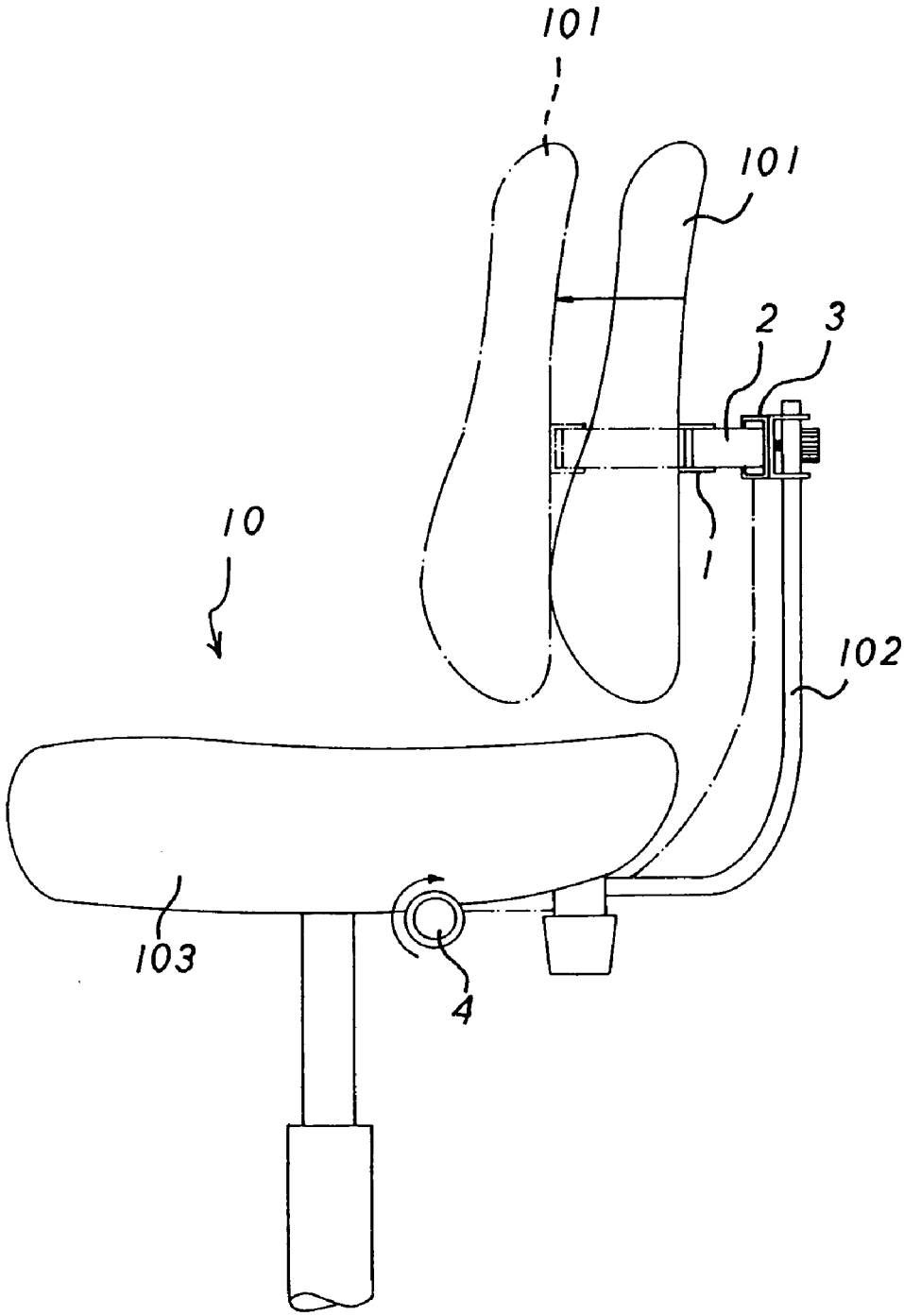
FIG. 3. is a schematic side plan operational view of the backrest adjustment device as shown in FIG. 1.

As shown in FIG. 3, the backrest adjustment device is mounted on a chair 10 including a backrest 101, a seat 103, and a support frame 102 mounted on the seat 103. The bottom board 3 is secured to the support frame 102, and the support board 1 is secured to the backrest 101. The backrest adjustment device further comprises a drive mechanism 4 mounted on the seat 103 and connected to the first end of each of the two linkages 2 to drive the first ends of the two linkages 2 to move relative to each other so that the two linkages 2 are pivoted to drive the support board 1 to move relative to the bottom board 3 to change the distance between the support board 1 and the bottom board 3 so as to adjust the position of the backrest 101 relative to the seat 103. At this time, the gear portions 21 of the two linkages 2 mesh with each other so that the second ends of the two linkages 2 are pivoted simultaneously and the two linkages 2 are pivoted simultaneously to change the distance between the support board 1 and the bottom board 3 so as to adjust the position of the backrest 101 relative to the seat 103 smoothly and exactly.

Figure 4:
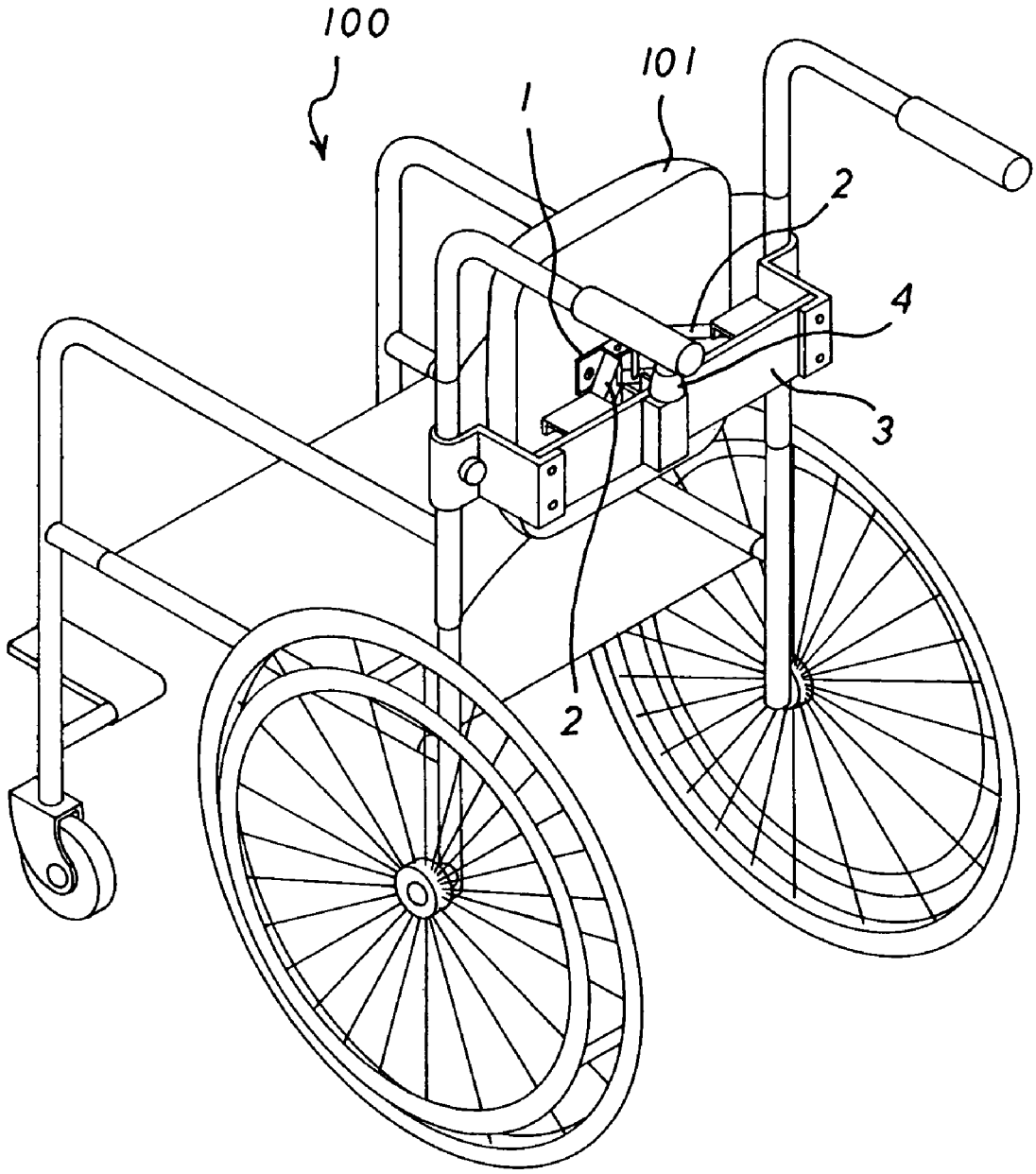
FIG. 4 is a schematic perspective operational view of the backrest adjustment device as shown in FIG. 1.

As shown in FIG. 4, the backrest adjustment device is mounted on a wheelchair 100.

Figure 5:
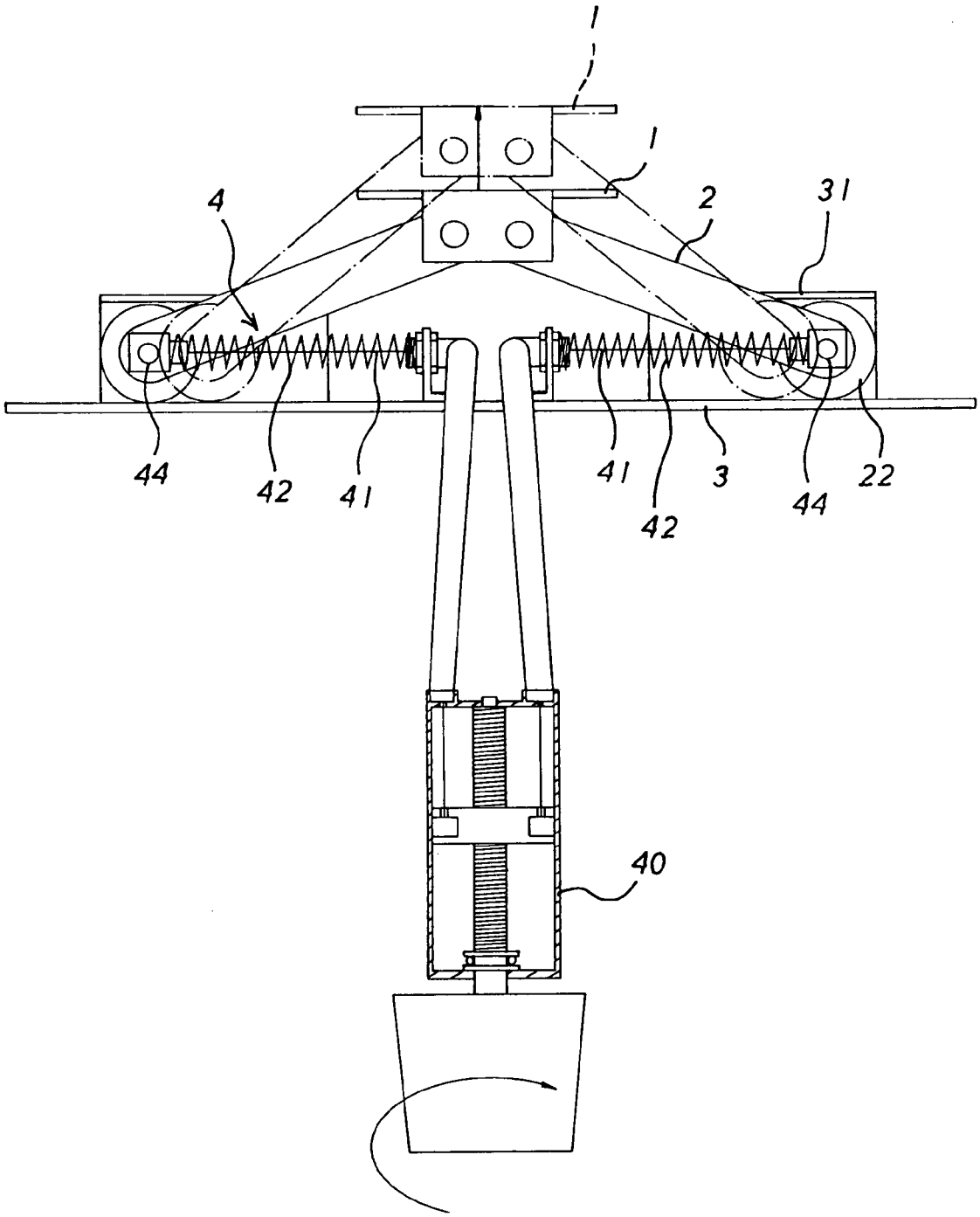
FIG. 5 is a plan cross-sectional operational view of the backrest adjustment device as shown in FIG. 1.

As shown in FIG. 5, the drive mechanism 4 includes two mounting members 44 each pivotally mounted on the first end of a respective one of the two linkages 2, two driving wires 41 each extended through the bottom board 3 and each having a first end connected to a respective one of the two mounting members 44, a wire adjuster 40 mounted on the bottom board 3 and connected to a second end of each of the two driving wires 41 to drive each of the two driving wires 41 to move each of the two mounting members 44, and two springs 42 each mounted on a respective one of the two driving wires 41 and biased between a respective one of the two mounting members 44 and the bottom board 3 to provide a restoring force to the respective mounting member 44 and the respective linkage 2.

In operation, the wire adjuster 40 drives the two driving wires 41 to drive the two mounting members 44 to move toward each other, so that the first ends of the two linkages 2 are moved toward each other and the two linkages 2 are moved toward each other to increase the distance between the support board 1 and the bottom board 3 so as to drive the backrest 101 to move forward as shown in FIG. 3. After the two driving wires 41 are released by the wire adjuster 40, the two mounting members 44 are moved outward relative to each other by the restoring force of the two springs 42, so that the first ends of the two linkages 2 are moved outward relative to each other and the two linkages 2 are moved outward relative to each other to reduce the distance between the support board 1 and the bottom board 3.

Figure 6:
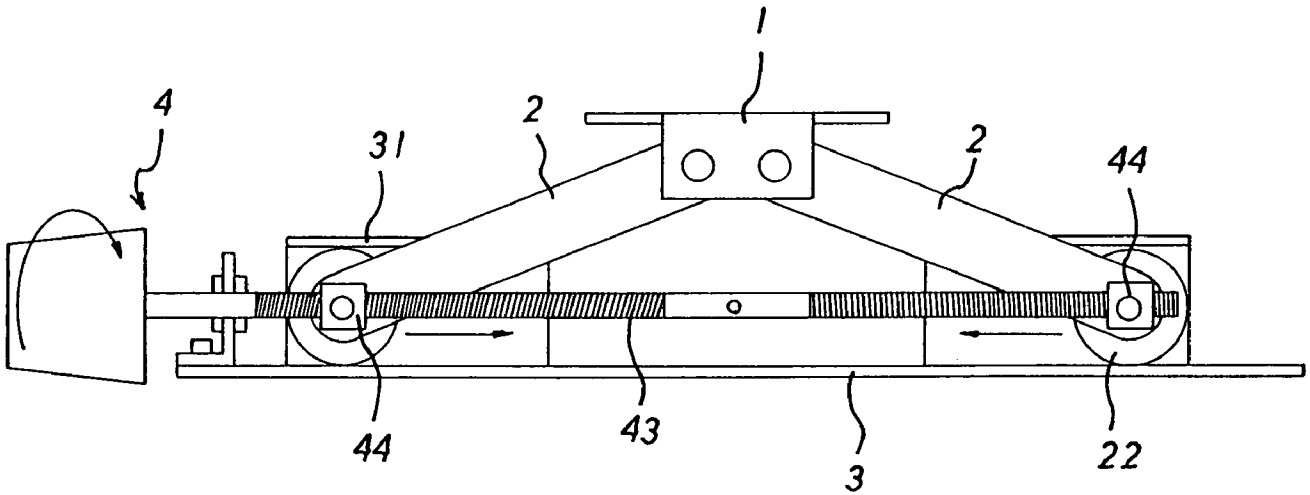
FIG. 6 is a plan cross-sectional view of a backrest adjustment device in accordance with another preferred embodiment of the present invention.

As shown in FIG. 6 with reference to FIGS. 1 and 2, the drive mechanism 4 includes two screwed mounting members 44 each pivotally mounted on the first end of a respective one of the two linkages 2, and a bi-directional threaded rod 43 rotatably mounted on the bottom board 3 and screwed into each of the two mounting members 44 to move the two mounting members 44 by rotation of the bi-directional threaded rod 43. Each of the two mounting members 44 is formed with a screw bore 440 screwed onto the bi-directional threaded rod 43, and the screw bores 440 of the two mounting members 44 have two opposite threading directions. Thus, the two linkages 2 are moved toward each other or moved outward relative to each other by rotation of the bi-directional threaded rod 43.

Figure 7:
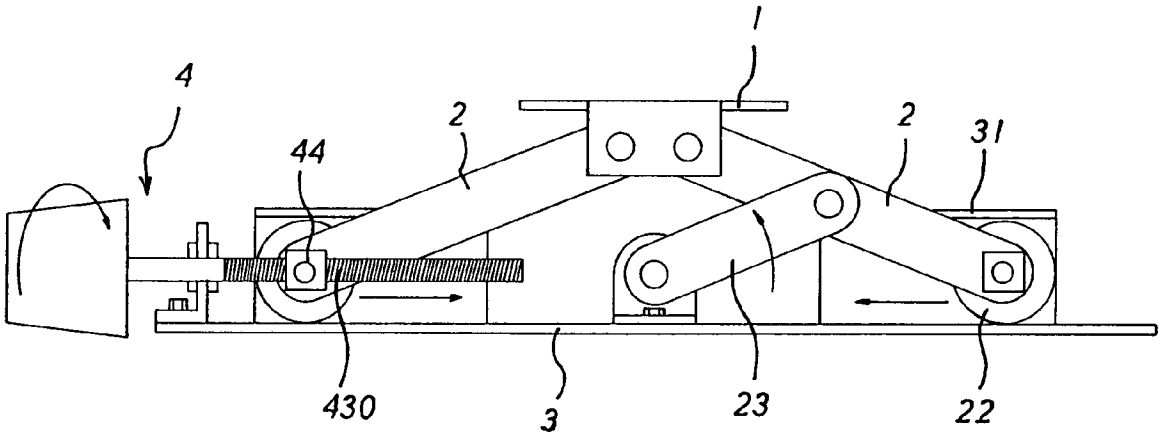
FIG. 7 is a plan cross-sectional view of a backrest adjustment device in accordance with another preferred embodiment of the present invention.

As shown in FIG. 7 with reference to FIGS. 1 and 2, the drive mechanism 4 includes a screwed mounting members 44 pivotally mounted on the first end of a first one of the two linkages 2, a threaded rod 430 rotatably mounted on the bottom board 3 and screwed into the mounting member 44 to move the mounting member 44 by rotation of the threaded rod 430, and a connecting lever 23 having a first end pivotally mounted on the bottom board 3 and a second end pivotally mounted on a second one of the two linkages 2. The mounting member 44 is formed with a screw bore 440 screwed onto the threaded rod 430. Thus, the two linkages 2 are moved toward each other or moved outward relative to each other by rotation of the threaded rod 430 and pivot action of the connecting lever 23.

Figure 8:
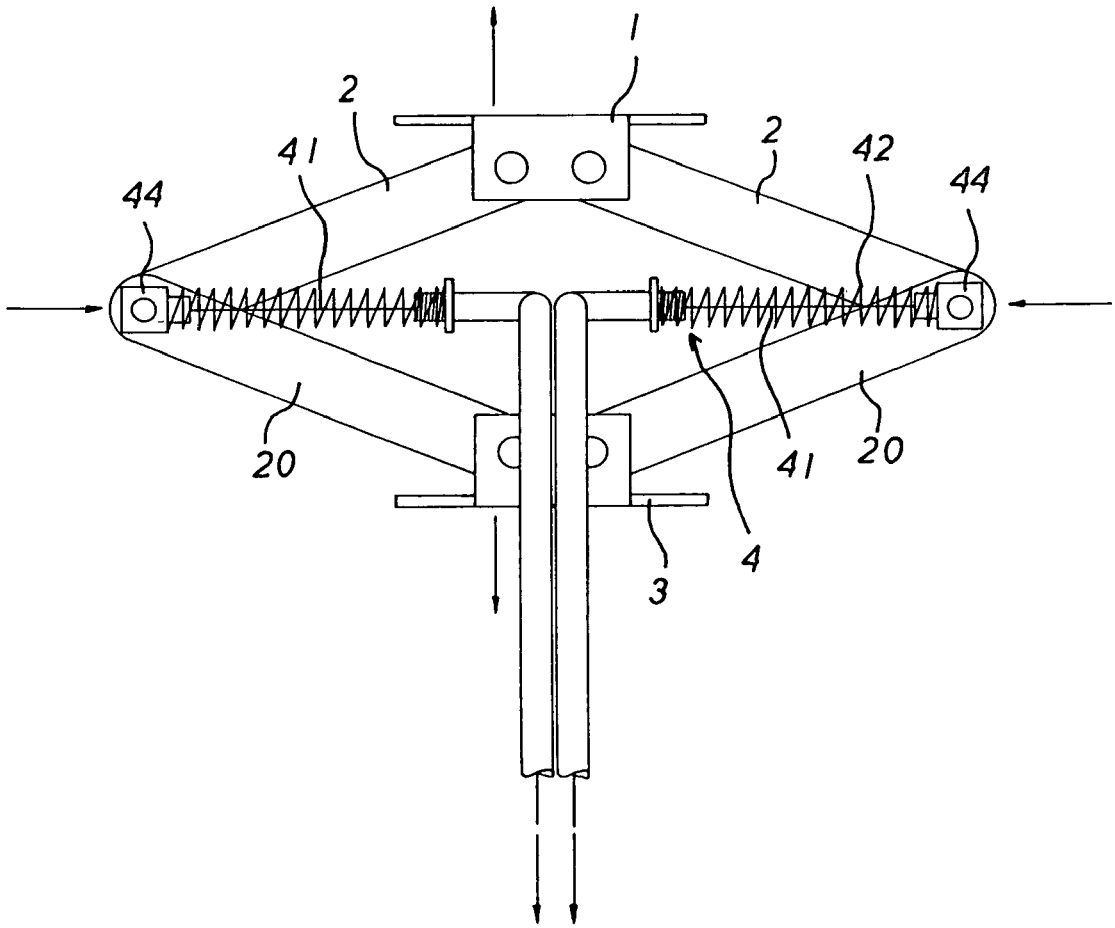
FIG. 8 is a plan cross-sectional view of a backrest adjustment device in accordance with another preferred embodiment of the present invention.

As shown in FIG. 8, the backrest adjustment device further comprises two opposite secondary linkages 20 pivotally mounted between the two linkages 2 and the bottom board 3 so that the two linkages 2 co-operate with the two secondary linkages 20 to drive the support board 1 to move relative to the bottom board 3 to change the distance between the support board 1 and the bottom board 3. Each of the two secondary linkages 20 has a first end movably mounted on the bottom board 3 and a second end pivotally connected to the first end of a respective one of the two linkages 2.

Accordingly, the two linkages 2 are pivoted to drive the support board 1 to move relative to the bottom board 3 to change the distance between the support board 1 and the bottom board 3 so as to adjust the position of the backrest 101 relative to the seat 103. In addition, the gear portions 21 of the two linkages 2 mesh with each other so that the two linkages 2 are pivoted simultaneously to change the distance between the support board 1 and the bottom board 3 so as to adjust the position of the backrest 101 relative to the seat 103 smoothly and exactly. Further, the two linkages 2 co-operate with the two secondary linkages 20 to drive the support board 1 to move relative to the bottom board 3 so as to doubly increase the travel between the support board 1 and the bottom board 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A backrest adjustment device, comprising:

a bottom board;

a support board movable relative to the bottom board;

two opposite linkages pivotally mounted between the support board and the bottom board to drive the support board to move relative to the bottom board to change a distance between the support board and the bottom board;

wherein each of the two linkages has a first end movably mounted on the bottom board and a second end pivotally mounted on the support board to drive the support board to move relative to the bottom board;

the second ends of the two linkages are engaged with each other so that the second ends of the two linkages are pivoted simultaneously;

the second end of each of the two linkages is formed with a gear portion, and the gear portions of the two linkages mesh with each other so that the second ends of the two linkages are pivoted simultaneously and the two linkages are pivoted simultaneously;

the backrest adjustment device further comprises a drive mechanism connected to the first end of each of the two linkages to drive the first ends of the two linkages to move relative to each other so that the two linkages are pivoted to drive the support board to move relative to the bottom board;

the drive mechanism includes:

two mounting members each pivotally mounted on the first end of a respective one of the two linkages;

two driving wires each extended through the bottom board and each having a first end connected to a respective one of the two mounting members;

a wire adjuster mounted on the bottom board and connected to a second end of each of the two driving wires to drive each of the two driving wires to move each of the two mounting members;

two springs each mounted on a respective one of the two driving wires and biased between a respective one of the two mounting members and the bottom board to provide a restoring force to the respective mounting member and the respective linkage.

2. The backrest adjustment device in accordance with claim 1, wherein the bottom board has two opposite ends spaced from each other and each provided with a guide track to guide sliding movement of the first end of a respective one of the two linkages.

3. The backrest adjustment device in accordance with claim 2, wherein the first end of each of the two linkages is provided with two spaced rollers rotatably mounted in the respective guide track of the bottom board.

4. The backrest adjustment device in accordance with claim 3, wherein each of the two mounting members is located between the two spaced rollers of the first end of the respective linkage.

5. The backrest adjustment device in accordance with claim 1, wherein the bottom board is secured to a support frame, and the support board is secured to a backrest.

* * * * *